United States Patent [19]

Cohen et al.

[11] 4,269,671

[45] May 26, 1981

[54] ELECTROPLATING OF SILVER-PALLADIUM ALLOYS AND RESULTING PRODUCT

[75] Inventors: Uri Cohen, Haifa, Israel; Richard Sard, Birmingham, Mich.

[73] Assignee: Bell Telephone Laboratories, Incorporated, Murray Hill, N.J.

[21] Appl. No.: 90,938

[22] Filed: Nov. 5, 1979

[51] Int. Cl.[3] ..... C25D 3/50; C25D 3/56; C25D 5/10; C25D 5/34

[52] U.S. Cl. ..... 204/23; 204/38 B; 204/40; 204/43 N

[58] Field of Search ..... 204/23, 40, 43 R, 43 N, 204/38 B

[56] References Cited

U.S. PATENT DOCUMENTS

| | | | |
|---|---|---|---|
| 3,053,741 | 9/1962 | Medina | 204/43 N |
| 3,711,383 | 1/1973 | Schiekel | 204/40 |
| 3,933,602 | 1/1976 | Henzl | 204/43 N |
| 4,001,093 | 1/1977 | Koontz | 204/15 |
| 4,177,114 | 12/1979 | Suzuki | 204/38 B |
| 4,203,810 | 5/1980 | Warne | 204/38 B |

OTHER PUBLICATIONS

Plating, Dec., 1948, pp. 1217–1219.

*Primary Examiner*—T. M. Tufariello
*Attorney, Agent, or Firm*—George S. Indig

[57] ABSTRACT

Palladium-silver alloy may be electroplated from lithium chloride bath solution to result in coatings useful for electrical contacts. Increased corrosion resistance relative to wrought contacts of the same composition permit relatively large amounts of silver.

13 Claims, 2 Drawing Figures

ELECTROPLATING OF SILVER-PALLADIUM ALLOYS AND RESULTING PRODUCT

BACKGROUND OF THE INVENTION

A. Technical Field

The invention is concerned with device uses of electroplated palladium-group alloys. Most noteworthy is the use of such materials for replacing gold in electrical contacts. Gold replacement is of increasing importance due to rising gold prices.

B. History

Palladium, as well as other members of the platinum group, have been used in alloyed or unalloyed form as electrical contact materials for some years. These noble metals and alloys are known to be inert to usual ambients, have requisite low contact resistance, and are or may become less expensive than gold and gold-based alloys.

It has been found that palladium alloyed with less expensive elements retain electrical properties to a sufficient degree to permit their use under many circumstances. Electrical contacts of 60% palladium-40% silver are in general use. Related compositions, some ternary or higher order, have been found satisfactory in contacts, generally of striking rather than sliding design.

While sliding contacts, for example, as used in the connector art, continue to be dominated by gold-cobalt and other hard gold alloys, studies designed to substitute palladium and other platinum-group based materials are under way. These studies have been encouraging, and it is likely that such substitution will gain increasing acceptance.

In general, palladium-containing alloys, have been used in electrical contacts in the form of wrought members. These members, sometimes in the form of small buttons, are affixed by riveting, crimping, welding, cladding, or other mechanical means. Although the literature abounds with references to electroplating techniques, it is not apparent that they have found industrial use for palladium-containing materials. Such materials apparently compete with gold-based electroplate only in the form of mechanically affixed contacts.

It is apparent that workers have been concerned for some years with plating of platinum-group materials. As an example, Brenner in *Electrodeposition of Alloys: Principles and Practice* reviews attempts to electroplate Ag-Pt alloys from a variety of bath compositions through 1960. He refers, in particular, to the work of Grahm et al, 35, *Plating,* 1217 (1948) in which the authors report on the use of a concentrated lithium chloride bath for the plating of Pt-containing silver alloys and comments that, in his opinion, the bath would be feasible for Pd-containing alloys as well. In later work, Andreeva et al, *Protective Metallic and Oxide Coatings, Metal Corrosion and Electrochemistry,* 1965, the authors report specifically on the plating of palladium alloys from an aqueous LiCl bath. Other bath compositions for plating of palladium-containing alloys include the EDTA reported by N. T. Kudryavtsev et al in 7(2) *Z. Metallov,* 206 (1971).

Nonacceptance of EDTA, particularly for silver-containing alloys of platinum-group elements, is probably due to difficulties reported by Kudryavtsev et al. The ammoniacal plating system appears to operate under conditions of silver diffusion limited current, which adversely affects the deposit morphology, thickness, and rate of growth. Nonuse of highly acid bath solutions, such as aqueous LiCl, is possibly due to violent substrate attack. Unprotected base metal substrates undergo vigorous displacement reactions which compete with and prevent uniform electroplating.

SUMMARY OF THE INVENTION

Palladium-silver alloys are electroplated from alkali or alkaline earth metal halide aqueous solutions to result in chemical and physical properties adequate for use for a variety of purposes including electrical contacts. Described plating methods have been successfully used to plate coatings of a variety of thicknesses at rates as high as about 9 μm per minute. Plating efficiencies approaching or equal to 100% permit this rate at current densities of a few hundred mA/cm$^2$. Substrate attack, for example, by concentrated LiCl bath is avoided by flash plating with a noble metal such as gold. Flash coating thicknesses of 0.5 μm or less have been found adequate.

While resulting plated articles may take many forms, use of the inventive plating methods is of greatest immediate interest in the fabrication of electrical contacts. These may take the form of the striking contacts which traditionally utilize wrought Pd or Pd alloys or electroplated gold, or they may take the form of sliding contacts which have generally depended on hard gold electroplating.

An unexpected advantage of the inventive platings is their improved corrosion properties relative to corresponding wrought alloys. This permits use of relatively large amounts of inexpensive alloying elements. Economy permitted by use, for example, of a plated Ag-40% Pd alloy in lieu of a wrought Ag-60% Pd alloy is exemplary of a preferred embodiment. Such preferred embodiments are defined in terms of plated articles, particularly plated contacts, which are plated in accordance with the inventive teaching and which contain at least 50 parts by weight and preferably at least 60 parts by weight of a total of 100 parts by weight of silver plus palladium plus other platinum group elements.

DETAILED DESCRIPTION

A. Composition

1. The Bath

Figure 1:
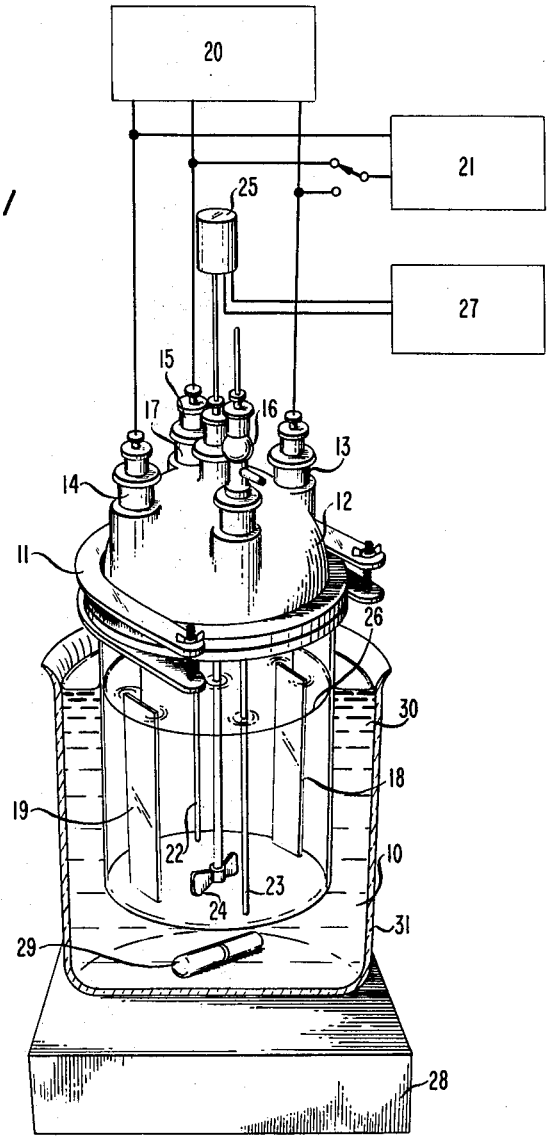

It is known that platinum-group elements are soluble in acid solution containing Li, alkali metal, or other alkaline earth cations (35 *Plating* 1217 (1948)). Bath solutions suitable for the practice of the invention are based on halides of such alkali or alkaline earth metals. A preferred embodiment is based on baths containing relatively large amounts of alkaline earth chlorides, e.g. 500 g LiCl/1,000 ml $H_2O$. A range may be defined as from 300 g/l to the solubility limit (~800 for LiCl). Lesser amounts result in lesser solubility for silver.

Monitoring the bath at a pH range from about 0.3 to about 1.0 is advised for the reason that solubility of silver halide decreases for higher pH while cracking of the plate is observed for lower values.

Palladium and other platinum-group cations, which may replace palladium in part, as well as silver, may be supplied by a disposable anode. In common with other noble plating processes, it is expected that use will be made of nondisposable anodes and that cation contribution will be from soluble compounds in the plating bath. In either event, bath composition may be considered in terms of effective halide content, e.g., AgCl and $PdCl_2$. For such plating compositions, Pt-group element is plated preferentially. The 3 gm $PdCl_2$-12 gm AgCl/liter bath which, in Example 1, yielded an Ag-40% Pd coating is indicative of the 2 to 4 times multiplication of Pt-group element in the coating relative to the bath under one set of plating conditions. A total bath cation content of at least 1 g/l is necessary to assure plating at a minimal rate of 0.1 μm/min. under many conditions. The upper limit is generally determined by silver solubility. Due to preferential Pd plating, relatively large amounts of dissolved silver are required. Concentration of this less soluble ingredient is increased further for given plate composition as plating rate is increased or as agitation is decreased. Plating rates of up to about 10 μm/min. are achieved from bath composition containing from 3 to 5 g/l of Pt-group cation. Use of these or greater concentrations minimizes need for compositional monitoring and expedites replenishment. Due to relative solubility, maximum Pt-group concentration is generally determined by the solubility limit for silver and by the bath ratio appropriate to plating conditions.

Plating composition within the scope of the inventive teaching is described under Section C.1. As there described, partial substitution of palladium is permitted to a maximum amount which approaches 10% by weight of the total plating. Composition is conveniently described in terms of the at least 90 weight percent which consists solely of palladium and silver. Relative silver content which derives in large part from observed increased corrosion resistance is, however, based on silver content relative to total platinum group content. Based on 100 parts by weight of platinum group elements together with silver, silver is set within the range of from about 30 parts to a maximum which, under many circumstances, is about 70 parts.

It has been indicated that bath compositions necessary to result in desired plating composition will necessarily contain greater amounts of palladium or other platinum group elements. Preferential plating of the more noble metals relative to silver results in local bath depletion with respect to noble metal which, in turn, gives rise to a need for larger amounts of noble metal in the bulk bath. Since replacement of noble metal within the depleted region adjacent the surface being plated becomes increasingly difficult for lower agitation or higher plating rates, needed concentration of platinum group elements is still further increased under such conditions.

Content of elements other than Ag and Pt-group elements is determined largely on the basis of tolerable corrosion or other properties. Hardness, toughness, ductility, and other mechanical properties are also affected and may be determining. Desired middle range bath compositions (centered about a 50–50% plating) may result from a 3:1 to 5:1 Ag content relative to Pt-group content always in terms of the related halides. In general, expedient plating to produce desired low corrosion alloyed contacts requires a halide weight ratio of Ag/Pt group of at least 3:1 corresponding, for example, to 3 g/l of AgCl for 1 g/l Pt-group content. For usual bath compositions and plating conditions, Ag content is simply set at that level required to yield desired plating composition. It is not altered during plating which is assumed to continue under altered conditions.

It has been indicated that pH is generally maintained within the range of from about 0.3 to about 1.0. Maintenance within this range may require acid addition, generally in amounts of up to about 50 ml/l. Concentrated HCl is satisfactory for use with chlorides.

Other bath ingredients are minor and include tolerable impurities, as well as intentional additions. Unintentional impurities, generally in amount to result in no more than a total of 1.0 weight percent in the plating include copper, nickel and other base metals. Additives, also in such amount, and preferably to result in a plating which is at least 99 weight percent platinum group elements plus silver, include brighteners and hardeners. Examples include antimony and other inorganic or organic brighteners.

Plating Conditions

Conditions, generally interrelated, relate to factors such as desired throughput, plating composition, apparatus design, etc. Discussion is generally in terms of the simple laboratory apparatus of FIG. 1. The apparatus of FIG. 2, more fully described in U.S. Pat. No. 4,001,093, is representative of high efficiency apparatus providing for turbulent flow and relatively high throughput. Plating conditions appropriate to this apparatus are noted.

B. Processing Conditions

In general terms, plating procedures of the invention are usefully carried out under a wide variety of conditions. While attack of any exposed base metal is a concern, noble metals are unaffected by the bath. Noble metal surfaces may be plated under conditions suitable to usual needs. Excellent plating quantity is attainable at any desired thickness over the broadest ranges available in other systems. Throughput is comparable to that of other systems so that thicknesses of up to 10 micrometers or more per minute are readily attainable. Detailed plating information was obtained generally on simple laboratory apparatus of the form depicted in FIG. 1. Plating parameters are generally discussed in terms of such operation. Regular production at high throughput, as well as uniform coating particularly for complex shapes, requires more sophisticated equipment. Illustrative equipment usefully applied to commercial plating processes is depicted in FIG. 2.

1. Substrate Preparation

High halide content within a pH range specified results in a displacement reaction for many base metals likely to be encountered. This reaction which generally results in loosely adherent powdery deposit is usually undesirable. It is totally avoided by flash plating of a noble metal. Flash plating of soft gold to a thickness of approximately 0.3 μm was used in the preparation of some of the base metal samples discussed, and soft gold plating within the thickness range of about 0.2 and 0.4 μm is considered exemplary. A number of compositions, (either bulk metal composition or coating composition) resist attack and may be used instead of gold. Examples are silver to about 1.0 μm, as well as other noble metals, also to at least about 1.0 μm. Lessor thicknesses may result in objectionable porosity permitting appreciable substrate attack by the bath. Silver is relatively unstable to displacement plating and, if used, should not be immersed more than a few seconds prior to electroplating. Coating to a variety of thicknesses as by evaporation, sputtering, CVD, etc., may be suitable to provide necessary stability for the required residence in the bath.

A variety of tests suggest some possible adhesion problem with silver substrate surfaces, as well as with less noble substrate surfaces. The problem usually detected as a powdery deposit may be indicated by discoloration of the plating. Changing electrode potential is a possible early indicator usefully employed in process monitoring. In all cases, as expected on the basis of bulk metal studies, protective coatings result in improved adherence. Soft gold plated to a thickness of 0.2–0.4 micrometer from buffered citrate solution, has been found effective. Such coatings, found somewhat preferable to hard gold or gold strike, are known to be of high density and relatively low porosity. They were effectively applied to unpolished, as well as mechanically polished, substrates of nickel, copper, and a variety of copper alloys.

The following procedure was found acceptable:

EXAMPLE 1

Substrate Preparation

Copper-nickel substrates (89 Cu-9 Ni-2 Sn) were treated as follows:

1. Immerse and lightly agitate first in acetone, finally, in trichloroethylene and shake dry.
2. Ultrasonically clean in alkaline cleansing solution for one minute.
3. Rinse in deionized water.
4. Rinse in 50 percent aqueous HCl for 30–60 seconds.
5. Rinse in deionized water.
6. Soft gold plate by making cathodic in a solution containing 20 g/l potassium gold cyanide, 50 g/l dibasic ammonium citrate, 50 g/l ammonium sulphate at a temperature of 65±5 degrees C., current density of 8 $mA/cm^2 \pm 2$ $mA/cm^2$ for 30–45 sec. with moderate stirring to result in a plating of from 0.2–0.4 $\mu m$.
7. Rinse in deionzied water and air dry.

(It was found that introduction of wet substrates at this stage resulted in precipitation, for example, of AgCl due to local chloride dilution. Precipitation was avoided by first dipping the substrate in a concentrated chloride solution.)

2. Current Density

Figure 2:
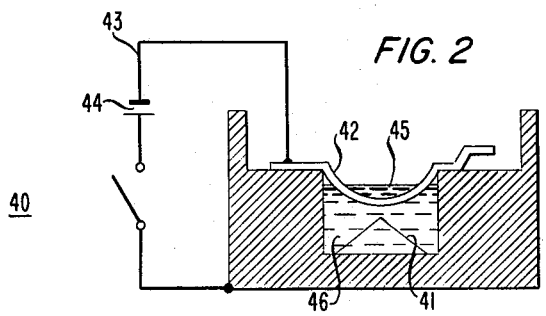

The following conclusions were based on use of apparatus such as that of FIG. 1 with plating being continued for a time sufficient to result in a coating thickness of about 10 micrometers. With moderate agitation, very low current densities—from 0.5 $mA/cm^2$ to about 2 $mA/cm^2$—tend to result in three-dimensional growth with plating having a grey matte appearance, as well as relatively high contact resistance. At 5 $mA/cm^2$, color was lighter and surface smoothness was improved. The range, 5–10 $mA/cm^2$, with moderate stirring resulted in good surface smoothness and low contact resistance. Current densities of 20 $mA/cm^2$ (for the degree of agitation used) resulted in deterioration (spontaneous cracking) at the edges where current density was highest.

Use of a forced flow cell design, such as that of FIG. 2, resulted in smooth coatings satisfactory for contact use at current densities greater than 200 $mA/cm^2$ (plating rate of about 9 micrometers/min.).

3. Temperature

In general, increasing temperature is desirable up to a maximum value at which loss through volatilization becomes significant. Higher plating rates, as well as relative freedom from compositional variation due to bath depletion, etc., result from increased saturation concentration with respect to all halides. While plating at room temperature may be acceptable, plating within the range of from 50 degrees C. to 100 degrees C. is preferred.

4. Other Conditions

Plating procedures of the invention are unaffected by usual atmospheric ambients. Many of the results reported were carried out in an uncovered apparatus in air.

In common with other plating procedures, controlled morphology, as well as thickness and other physical characteristics of the coating, depends upon relatively uniform plating conditions across the entire surface. Apparatus such as that of FIG. 2, with anodes shaped to accommodate configurations being plated is suitably employed.

C. Plating Characteristics

1. Composition

The thrust of the invention is the electroplating of palladium-silver alloys and resulting product. The inventive teaching is considered to include processes which result in platings, as well as platings, themselves, which consist of at least 90% by weight of palladium and silver. Such platings, which may be produced from alkali or alkaline earth metal halides, may contain other platinum group elements, and it is expected that plated alloys containing least permitted amounts of palladium and silver will contain other platinum group elements as the major portion of the remainder. Constituents other than silver and platinum group elements are contained in relatively small amounts for well-known purposes. Prime examples include hardeners and brighteners which may be organic or inorganic and which are detectable in the plating at levels generally below 1 weight percent.

The major thrust of the invention concerns the relatively large amounts of silver permitted due to enhanced corrosion resistance of platings of the invention. The significant ratio here is that of silver relative to total platinum group content in the plating, even though, for usual compositions, the ratio is simply that of silver and palladium. Enhanced corrosion resistance permits use of as much as about 70 parts by weight of silver in 100 parts of platinum group-silver. Larger amounts of silver, under many processing conditions, result in powdery deposit. For the purposes of the invention, neither corrosion resistance nor economic advantage is retained by use of less than about 30 parts by weight silver (again, based on 100 parts of total platinum group and silver) and, for this reason, the minimum is so expressed.

It has been noted that a significant aspect of the invention derives from the observation that a given level of corrosion resistance results in plated alloy which is comparatively rich in silver. Specifications for palladium silver wrought contacts often specify a maximum of about 40% silver in contemplation of needed life under usually encountered conditions. A significant aspect of the invention may be defined, therefore, in terms of contacts plated in accordance with the invention containing some greater amount than 40% silver—e.g., greater than about 50 parts by weight based on 100 parts of silver, palladium, and other platinum group elements. A still more preferred embodiment is defined in terms of such plated contacts containing at least 60 parts silver on the same basis. As noted, test results suggest the latter composition as plated to be the equivalent of 40 parts by weight silver wrought contacts from the corrosion standpoint.

2. Microstructure

Transmission electron microscopy examination revealed a grain structure of 100–300 Angstrom units. Voids of up to about 30 Angstrom units were seen at grain boundaries. Second phase precipitates were absent. Based on electron, as well as X-ray diffraction pattern, alloy coatings were found to be compositionally homogeneous and of single-phase. Measurements indicated structure to be face centered cubic (FCC) with a lattice parameter which increases with decreasing Pd content in a manner similar to that for wrought alloy. DC current plating of Ag-Pd resulted in coatings having a pronounced texture corresponding with preferred orientation in a [100] direction.

3. Microhardness

Knoop measurement with a 25 g load on polished cross-sections of coatings of a thickness of at least 10 micrometers yielded values generally in the range of from 180–220 kg/mm$^2$.

4. Internal Stress

Internal macrostress was monitored with an electronic spiral contractometer. The procedure involved use of spirals of stainless steel 0.020-inch thick plated with 2 $\mu$m Ni followed by 2 $\mu$m soft gold prior to Ag-Pd plating. Increasing current density resulted in a decrease in tensile stress with observed values for 2.5 micrometer plating thickness varying from 5,000 psi tensile at 2 mA/cm$^2$ to 5,000 psi compressive for 20 mA/cm$^2$, both at moderate stirring (apparatus of FIG. 1). Macrostress was found to be essentially independent of bath temperature with variations of 10 degrees C. from a center value of 85 degrees C. having no measurable effect. These values are comparable to commercial acid-copper as well as sulfamate nickel and are lower than values associated with cobalt hardened gold, as well as tin-nickel.

5. Contact Resistance

Measurement with 4 point probe at 100 g force yielded typical contact resistance measured values of about 1 milliohm. The same measurement made on coatings exposed to an environment containing flowers of sulfur and 85 percent relative humidity at 50 degrees C. yielded essentially identical measured values for plated Ag-Pd coatings up to about 60 percent Ag. Increase in resistance was significantly lower for plated coatings than for bulk alloy (wrought alloy). A 40 Ag–60 Pd bulk alloy showed a contact resistance change of about 5 m$\Omega$, while the corresponding change for plated alloys was less than 0.3 m$\Omega$. Corrosion resistance of plated Ag-Pd is, by this test, comparable to that of plated hard gold.

6. Wear and Friction

Synthetic hydrocarbon liquid lubricant was found superior to solid wax for silver alloy coatings. Wear response for paired sliding contacts of Ag-Pd was adequate only for less demanding applications. Paired contacts, one of Ag-Pd and the other of hard gold, exhibited behavior similar to that of paired hard gold contacts.

D. THE DRAWING

1. Preliminary Description

FIG. 1 is a perspective view, partly in section, of the plating cell which was used to develop much of the data presented; and FIG. 2 is a perspective view, partly in section, of commercial plating apparatus providing for high turbulent flow rates and high throughput.

2. Detailed Description of the Drawing

The apparatus of FIG. 1 consists of a 500 ml reaction flask 10 sealed by means of clamp 11 to an "0" ring fitted cover 12 provided with five standard tapered joints 13, 14, 15, 16, 17. Flask 10 contains anode 18 and cathode 19 electrically accessed through joints 13 and 14 by a power supply and voltage measuring apparatus shown as a single block 20. Date reported herein was measured by means of measuring apparatus, generally an x-y recorder, depicted as block 21 which was used to measure anode potential relative to reference electrode 22, which is a platinum-group metal wire accessed through joint 15. Thermometer 23 inserted through joint 16, stirrer 24 accessed through joint 17 and driven by motor 25, together with bath 26, complete the flask contents depicted. Variation in stirring rate was provided by a control shown schematically as block 27, while bath temperature was controlled through heating means 28 and magnetic stirring element 29 via oil bath 30 in jacket 31.

FIG. 2 is representative of apparatus more completely described in U.S. Pat. No. 4,001,093. It utilizes shaped electrodes and a forced flow pattern designed to accommodate structures such as those including the printed circuit contact fingers depicted. A typical cell design with an inserted circuit board is shown.

The plating cell 40 depicted includes triangular-shaped anode 41, and a surface 42 to be plated. It is provided with circuitry 43 including biasing source 44 for biasing surface 42 positive with respect to electrode 41. The apparatus shown is designed to yield a high nonuniform plating concentrated in the central portion 45 of surface 42. The view is representative of in-line apparatus in which movement of surface 42 is normal to the page and in which electrolyte 46 is rapidly moved to result in turbidity at the region being plated.

We claim:

1. Procedure for fabrication of an article, said procedure including electroplating at least a region of the said article with an alloy at least 90 percent by weight of which contains at least 30 weight percent silver, remainder palladium in accordance with which the region of the article to be plated is biased cathodically relative to an anode, with both the said region and the anode wetted by liquid electroplating bath to form a continuous path for ionic transfer between the said article and the said anode, characterized in that the said bath may be considered as consisting primarily of an aqueous solution of at least one alkali metal or alkaline earth metal halide together with palladium halide, any other platinum group halide/s and silver halide and in which the article to be plated is protected from chemical attack by the said bath by a noble metal surface.

2. Process of claim 1 in which the said noble metal surface is a deposited layer on a nonnoble metal surface.

3. Process of claim 2 in which the said deposited layer consists essentially of silver.

4. Process of claim 2 in which the said deposited layer is soft gold.

5. Process of claim 4 in which the deposited layer is of a thickness of from about 0.2 $\mu$m to about 0.4 $\mu$m.

6. Process of claim 1 in which the said alloy contains at least 50 parts by weight of silver based on 100 parts by weight of silver plus palladium plus any other platinum group elements.

7. Process of claim 6 in which the said alloy contains at least 60 parts by weight of silver on the same basis.

8. Process of claim 1 in which the said halide is chloride and in which the pH of the said bath is within the range of from about 0.3 to about 1.0.

9. Process of claim 8 in which the said alkali metal or alkaline earth metal halide consists essentially of lithium chloride.

10. Process of claim 1 in which the said region is an electrical contact region.

11. Process of claim 1 in which the bath is agitated sufficiently to result in turbulence in the vicinity of the said region and in which the plating rate is maintained at a level of at least 5 μm/min.

12. Process of claim 11 in which the plating rate is maintained at a level of at least about 10 μm/min.

13. Product produced in accordance with the process of claim 1.

* * * * *

UNITED STATES PATENT AND TRADEMARK OFFICE

CERTIFICATE OF CORRECTION

PATENT NO. : 4,269,671

DATED : May 26, 1981

INVENTOR(S) : Uri Cohen and Richard Sard

It is certified that error appears in the above-identified patent and that said Letters Patent are hereby corrected as shown below:

Column 4, line 42, "a" should read --the--; line 55, "Lessor" should read --Lesser--. Column 8, line 15, "Date" should read --Data--.

Signed and Sealed this

*Seventh* Day of *September 1982*

[SEAL]

*Attest:*

GERALD J. MOSSINGHOFF

*Attesting Officer*

*Commissioner of Patents and Trademarks*